US005772402A

United States Patent [19]

Goodman

[11] Patent Number: 5,772,402

[45] Date of Patent: Jun. 30, 1998

[54] PRE-CHARGED VACUUM FLUID CHANGE/DISPOSAL APPARATUS

[76] Inventor: Lowell R. Goodman, Waterman Beach Rd., Box 632, So. Thomaston, Me. 04858

[21] Appl. No.: 395,805

[22] Filed: Feb. 28, 1995

Related U.S. Application Data

[62] Division of Ser. No. 913,650, Jul. 13, 1992, Pat. No. 5,405,247, which is a continuation of Ser. No. 545,078, Jun. 29, 1990, abandoned.

[51] Int. Cl.[6] ..... F16N 33/00

[52] U.S. Cl. ..... 417/118; 184/1.5; 141/98; 137/205

[58] Field of Search ..... 417/118, 122; 184/1.5; 141/67, 91, 92, 98; 137/205

[56] References Cited

U.S. PATENT DOCUMENTS

| | | | |
|---|---|---|---|
| 1,986,476 | 1/1935 | Ironside | 184/1.5 |
| 2,158,914 | 5/1939 | Rinehart | 184/1.5 |
| 3,773,091 | 11/1973 | Boyd et al. | 184/1.5 |
| 4,095,672 | 6/1978 | Senese | 184/1.5 |
| 4,378,026 | 3/1983 | Bauer | 137/205 |
| 4,807,674 | 2/1989 | Sweet | 137/205 |
| 4,976,235 | 12/1990 | Commanday | 184/1.5 |

FOREIGN PATENT DOCUMENTS

| | | | |
|---|---|---|---|
| 2816666 | 10/1979 | Germany | 184/1.5 |

*Primary Examiner*—Roland McAndrews
*Attorney, Agent, or Firm*—Stan Jones

[57] ABSTRACT

An apparatus and method of use thereof includes a rechargeable, pre-charged vacuum canister used to remove viscous fluids, e.g., waste oil, from containers such as engine crankcases through an opening, such as a dipstick tube. The self-contained canister is first pre-charged with a near absolute vacuum. Due to the compressibility characteristics of air, conventional, active, continuous pumping techniques, which rely on partial vacuums, do not achieve the pulling force of the near absolute vacuums achieved by the invention. The use of a self-contained, pre-charged near absolute vacuum canister system significantly increases the force applied to the viscous fluid to be extracted. Furthermore, the fluid can be simultaneously contained in a proper disposal container. As a result shortcomings of manual and electric pumping systems are overcome with the added advantage that no external pumping force is required at the site of fluid removal.

32 Claims, 6 Drawing Sheets

PRE-CHARGED VACUUM FLUID CHANGE/ DISPOSAL APPARATUS

This is a divisional application of 07/913,650, filed Jul. 13, 1992, now U.S. Pat. No. 5,405,247, which is a continuation of 07/545,078, filed Jun. 29, 1990, now abandoned.

BACKGROUND OF THE INVENTION

1. Field of the Invention

The invention relates to the field of vacuum "pumping" systems for extracting fluids from difficult access areas such as engine crankcases, and transmission reservoirs. Specifically, the invention relates to a vacuum operated pumping system which extracts viscous fluids through small diameter openings (e.g., engine crankcases through oil dipstick holes).

2. Related Art

Many oil pumping systems for marine, automotive, aviation and stationary engines have been proposed. These systems have evolved to facilitate the periodic oil change requirement for these engines.

The primary factor driving the evolution of these extraction systems is the limited access underneath or difficult access to an engine's gravity drain system. Most attempts to alleviate these access problems have been directed toward manual or electric pumping systems, which pump oil or other fluid up through a small tube inserted through the engine dipstick tube. By design, these systems use "pumping" techniques which are constrained by physics to apply only a small psi force to the oil or other fluid without the application of excessive electrical horsepower. Due to the compressibility characteristics of air in conjunction with viscous fluids, pumping techniques using suction, which rely on a partial vacuum, cannot achieve the pulling force of a near absolute vacuum. In addition, the pumps of such systems often require external sources of power, such as electric power, which may not be readily available. Thus, many systems presently in use are operationally difficult. Moreover, their designs are inherently prone to oil spills, since most systems do not provide an acceptable container for transporting waste oil or other fluid to a proper disposal facility.

Conventional pumping systems which employ partial vacuums also cannot utilize the full capacity of the tank or canister. This is because the incoming incompressible fluid rapidly begins compressing the remaining air in the partial vacuum canister, thereby reaching pressure equalization before the canister capacity is consumed. Pumping rates of systems which employ vacuum techniques also fail to provide a constant rate of pumping because only a partial vacuum is available initially. As the tank accepting the waste fluid becomes filled, the rate of pumping slows down due to the partial vacuum.

For the reasons stated above, there exists a need for a thorough, clean, pumping system that works efficiently and provides an appropriate receptacle for waste fluid until disposition.

SUMMARY OF THE INVENTION

In view of the above described limitations of the related art, it is an object of the invention to provide a method and apparatus for extracting fluid from a container without the need for externally powered pumps.

It is a further object of the invention to provide a method and apparatus for extracting fluid from a container that allows simple and clean extraction of fluid contained in difficult to access containers.

It is still another object of the invention to provide a method and apparatus for extracting fluid that allows the use of almost all the storage capacity of the receiving vessel.

It is still another object of the invention to provide a method and apparatus that extracts fluid from a container at a substantially constant rate, even in the absence of external power sources.

The invention seeks to overcome the shortcomings of conventional manual and electric liquid pumping systems and accomplish the above objects of the invention through an easily rechargeable, self-contained, pre-charged vacuum canister. The pre-charged canister can be transported to any site and used without any other energy source by actuating a simple on/off valve to apply the vacuum to the fluid. The invention includes a container suitable to maintain 29" of vacuum. The tank or canister is pre-charged to this level, either before or after transport to a pumping site. Further, an air actuated vacuum mechanism, such as a two stage venturi pump, may be incorporated to facilitate a user's recharging of the canister. With this device, the required vacuum is developed in a short period of time using a normal shop compressor or service station air system. Other vacuum pumps, such as manual or electrically powered pumps, may be employed in place of the air pressure activated venturi pump. Because of the full vacuum available initially, the system applies a near constant force throughout the extraction process until the container is above 95% full. This allows a near constant rate of extraction of the fluid into the canister throughout the entire extraction process. A tube suitable in size to be inserted into most dipstick holes is attached to the canister to withdraw waste fluid from its container. A valve suitable to maintain the vacuum is attached between the canister and the suction tube.

These and other objects of the invention will become apparent to one of skill in the art upon a reading of the following detailed description along with the accompanying drawings which form a part thereof.

DETAILED DESCRIPTION OF THE PREFERRED EMBODIMENTS

The invention involves the application of a near absolute vacuum via a pre-charged, self-contained canister which can be transported to any site and used without any other energy source to remove viscous engine liquids from difficult to access places. While several embodiments are described, it will be obvious to one of ordinary skill that other embodiments are also possible within the scope of the invention described herein and articulated in the claims. The embodiments include a basic version suitable for recharging by evacuating the canister through a suction tube, a pre-charged version easily applied to the rental market, a version employing an air pressure activated vacuum pump to establish the vacuum and two versions having a second compartment to carry replenishing fluid.

Figure 1:
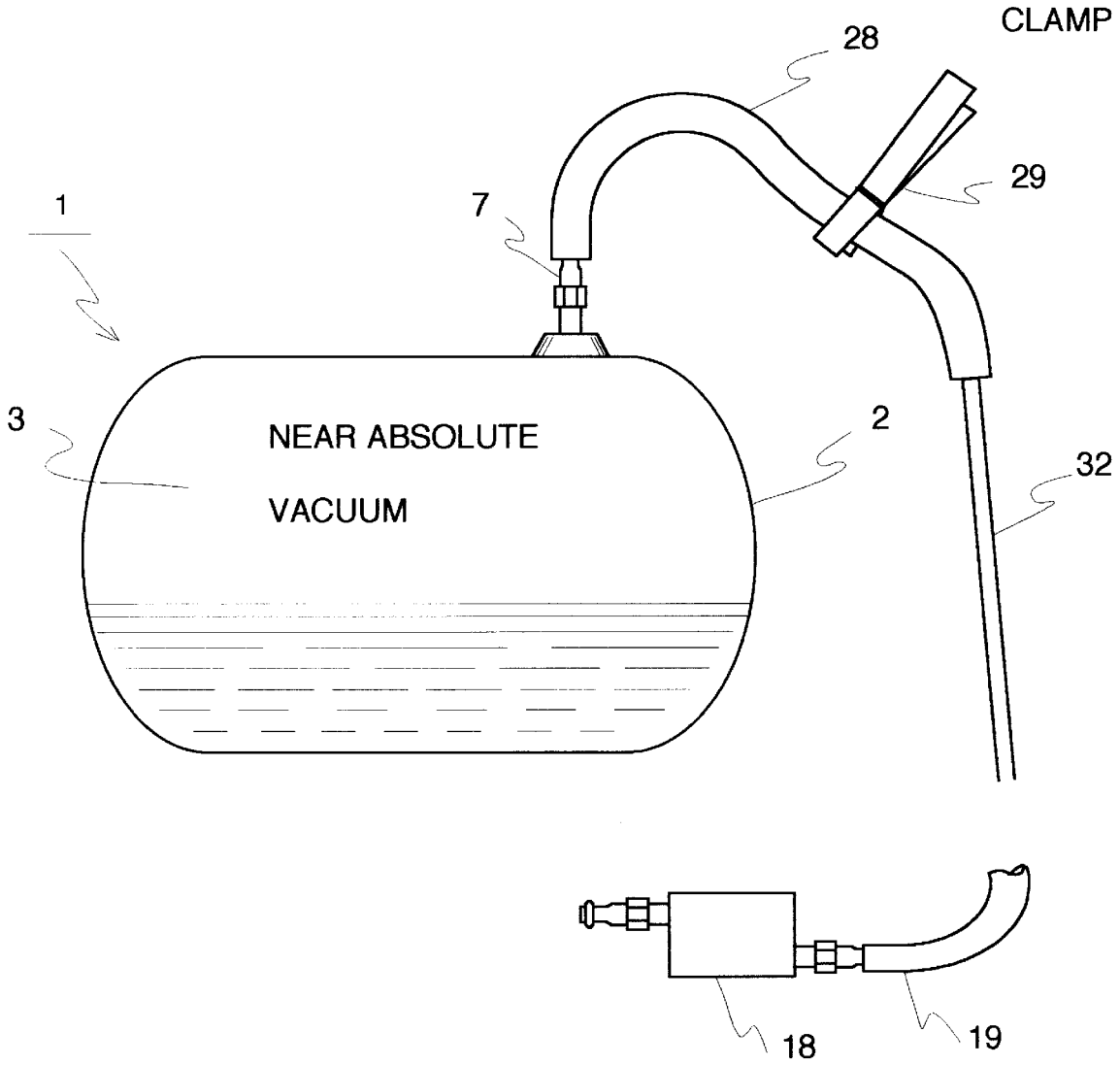
FIG. 1 illustrates a first embodiment of the invention.

In the first embodiment of the invention shown in FIG. 1, pre-charged canister system 1 has tank 2 formed of a suitable material to hold a viscous fluid and a vacuum in the inside 3 of the tank. By way of illustration only, and not as a limitation, the invention is described in the context of extracting oil from an engine crankcase. It will be clear to those of ordinary skill in the art that the principles of the invention are equally applicable to extracting other fluids from the same or other containers and that tank 2 and other parts of the invention can be formed by known means to accommodate the characteristics of such fluids. Tank 2 is connected by suction hose barb 7 located with access to the inside 3 of tank 2. Suction hose barb 7 connects to one end of suction hose 28 which can be clamped by a canister sealing or closing means, such as clamp 29. Clamp 29 may be an adjustable device permanently affixed by an attachment means to hose 28 or it may be a separate clamp placed and tightened on the hose where required. The other end of hose 28 is connected to a first end of a smaller diameter semi-rigid suction hose 32.

In order to evacuate tank 2 to approximately 29" of mercury, one end of hose 19 is slipped on the second end of semi-rigid tube 32. The other end of hose 19 is connected to any known vacuum pump 18, which is then activated. When the vacuum pump 18 reaches full vacuum, clamp 29 is placed on hose 28. The canister is thus pre-charged and ready for use in extracting fluid. It should be noted that the canister can be evacuated using a separate entry point and a check valve and that an on/off valve can be employed in place of clamp 29.

After charging, the pre-charged canister unit is then transported to the engine or other container to be drained. Of course, the canister unit can be charged at the site if so desired. Semi-rigid tube 32 is inserted to the bottom of the engine oil container through the engine dipstick tube in preparation of the engine oil change. Clamp or valve 29 is then removed to allow the vacuum actuated tank 2 to pull the oil out of the engine.

Warm waste engine oil is typically removed at the rate of approximately one quart per 40 seconds for a 3/16 inch inside diameter tube. Throughout this specification extraction rates assume a 3/16 inch inside diameter tube is used. It should be noted that where the inside diameter is larger the speed of extraction is faster. When the tube is clear, clamp 29 is replaced on suction hose 28 and semi-rigid hose 32 is then pulled from the dipstick tube, to complete the extraction process.

Waste fluid which is now in tank 2 in place of the vacuum, can then be drained. One draining process involves attaching a vacuum to the canister and sucking the oil out. Another draining method is to pressurize tank 2 either through the suction hose 28 or at hose barb 7 and turn the tank upside down, thereby putting the air pressure above the waste fluid. This will cause the fluid to be flushed from the tank.

Figure 2:
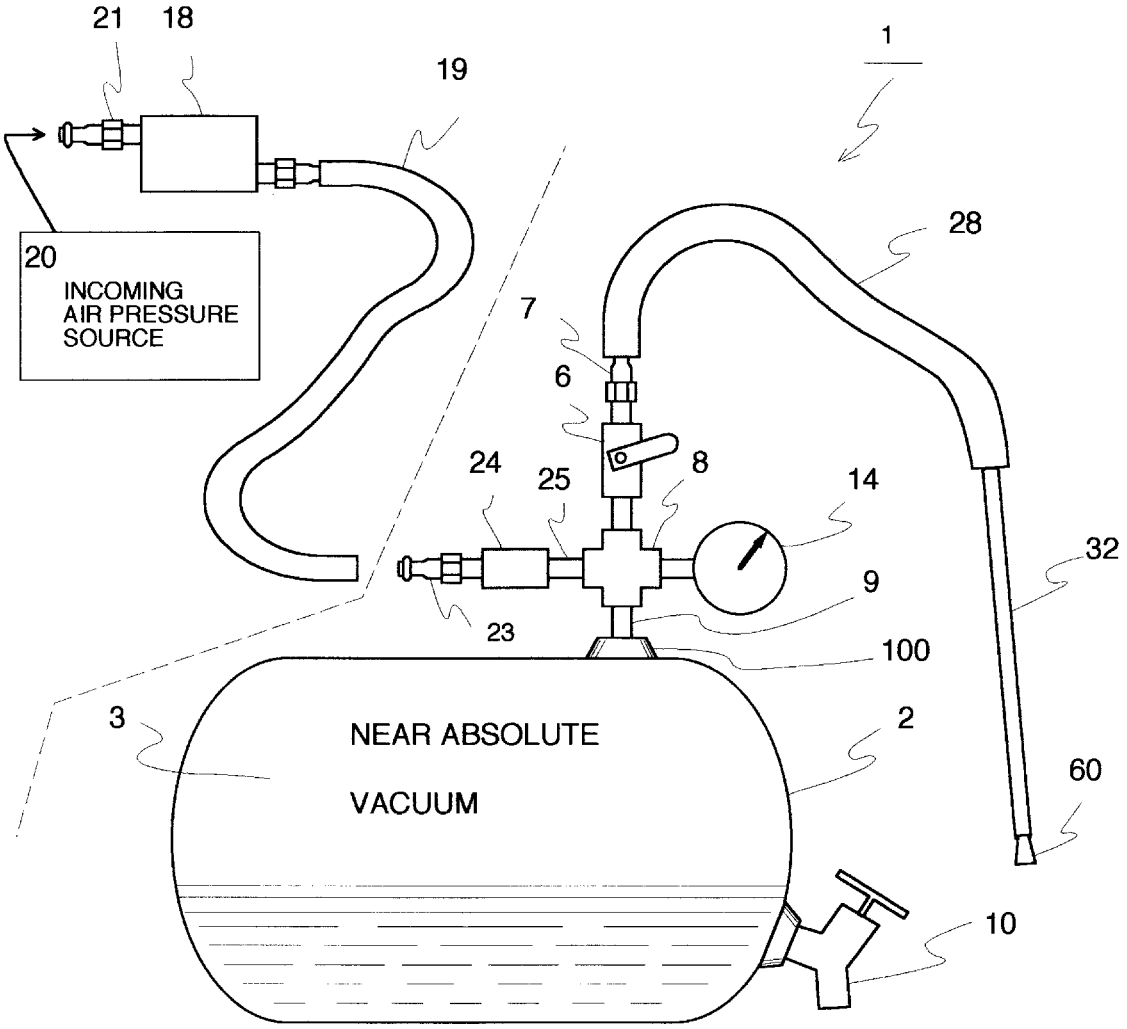
FIG. 2 illustrates a second embodiment of the invention employing a fluid disposal pre-charged vacuum canister.

In the embodiment shown in FIG. 2, nipple 9 at tank access 100 is attached to a first side of crossblock 8. Nipple 25 is attached between a second side of crossblock 8 and check valve 24, which mates with hose barb 23. Hose barb 23 can be used to attach hose 19, which is connected to vacuum pump 18. Check valve 24 operates to hold the vacuum in tank 2. A vacuum gage 14 can also be connected to the crossblock 8 to measure the vacuum. On/off valve 6 is connected between the crossblock 8 and suction hose barb 7 to control the vacuum which pulls fluid from a container (not shown) through semi-rigid suction hose 32 and suction hose 28.

In operation, the tank 2 is evacuated to approximately 29" of mercury through hose 19, check valve 24, nipple 25, and valve 6 by way of external vacuum pump 18. In one kind of vacuum pump, any available pressurized air source 20 is attached for several minutes to the pump 18 using quick coupler 21. Air pressure through the vacuum pump 18 creates a vacuum in the tank 2. Hose 19 temporarily attaches the vacuum pump to the tank by way of hose barb 23, check valve 24, nipple 25, crossblock 8 and nipple 9.

The level of vacuum inside canister compartment 3 is read on vacuum gage 14 which monitors the vacuum in the tank through the crossblock 8. Once 29" or other appropriate level of vacuum is reached on gage 14, check valve 24 holds the vacuum in tank 2. The canister is thus pre-charged. The pump 18 and vacuum hose 19 are then removed from hose barb 23 and the canister is ready for use. Alternately, the unit may use a check valve at a separate entry point for holding the vacuum.

The pre-charged canister unit is then transported to the engine and semi-rigid tube 32 is inserted into the bottom of engine oil container through the engine dipstick tube (not shown) in preparation of the engine oil change. The valve 6 is then turned to the "vacuum on" position and the vacuum pulls the oil out of the engine.

Warm waste engine oil is typically removed at the rate of approximately one quart per 40 seconds. When the tube is clear, valve 6 is shut off, semi-rigid tube 32 is pulled from the engine dipstick tube (not shown), and the process is complete. The waste oil which is now in the tank in place of the vacuum can then be drained through drain petcock 10 at an appropriate facility and the unit can then be readied via the same pre-charging process for another use.

Figure 3:
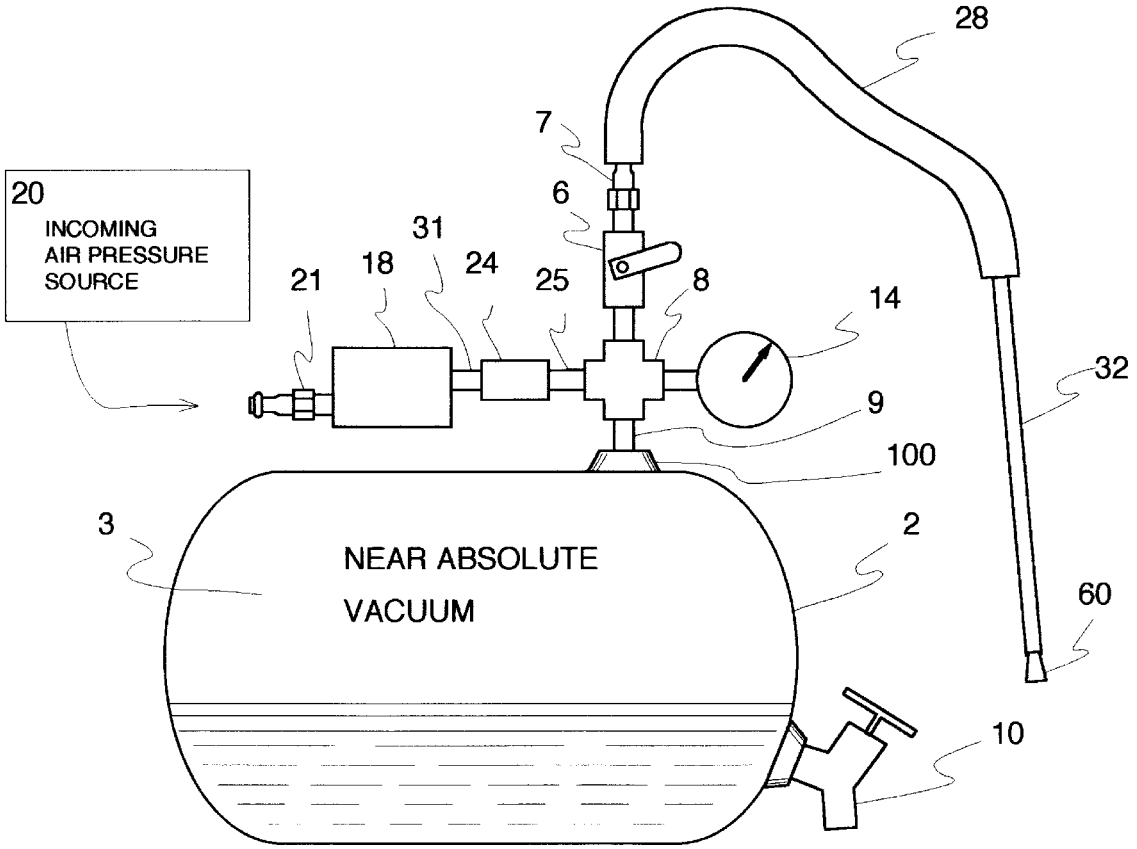
FIG. 3 illustrates a third embodiment of the invention employing an air pressure activated vacuum pump.

FIG. 3 shows an embodiment similar to that of FIG. 2 but with an air activated pump which is a part of the system 1. In this variation, the vacuum is created by an integral two-stage venturi 18 which can be energized by air pressure of approximately 60–90 psi and 0.5 to 1.3 cubic feet per minute (cfm). This allows the unit to be charged with any air compressor 20 having proper pressure, such as those typical of local service stations, which can be attached, for example, to quick coupler 21.

The unit is charged by applying the pressurized air to the vacuum pump 18 through quick coulper 21. Typically, the tank 2 can be vacated to 29 inches of mercury in several minutes. Once the air pressure is removed, check valve 24 holds the vacuum. The level of vacuum is read on vacuum gage 14 which monitors the vacuum in the tank through the crossblock 8, as previously described. Once 29" or other desired level of vacuum is reached on gage 14, the external quick coupler 21 is disconnected and the check valve 24 holds the vacuum in the tank, leaving the canister charged and ready for use.

The entire system 1 is then transported to the engine and semi-rigid tube 32 is inserted into the bottom of an engine oil container through the engine dipstick tube (not shown) in preparation of the engine oil change. The valve 6 is then turned to the "vacuum on" position and the vacuum pulls the oil out of the engine. Warm engine oil is removed at the rate of approximately one quart per 40 seconds. When semi-rigid tube 32 is clear, valve 6 is shut off, semi-rigid tube 32 is pulled from the dipstick tube, and the process is complete.

The waste oil which is now in the tank in place of the vacuum can then be drained through drain petcock 10 at an appropriate facility and the unit can then be readied via the same pre-charging process for another use.

Figure 4:
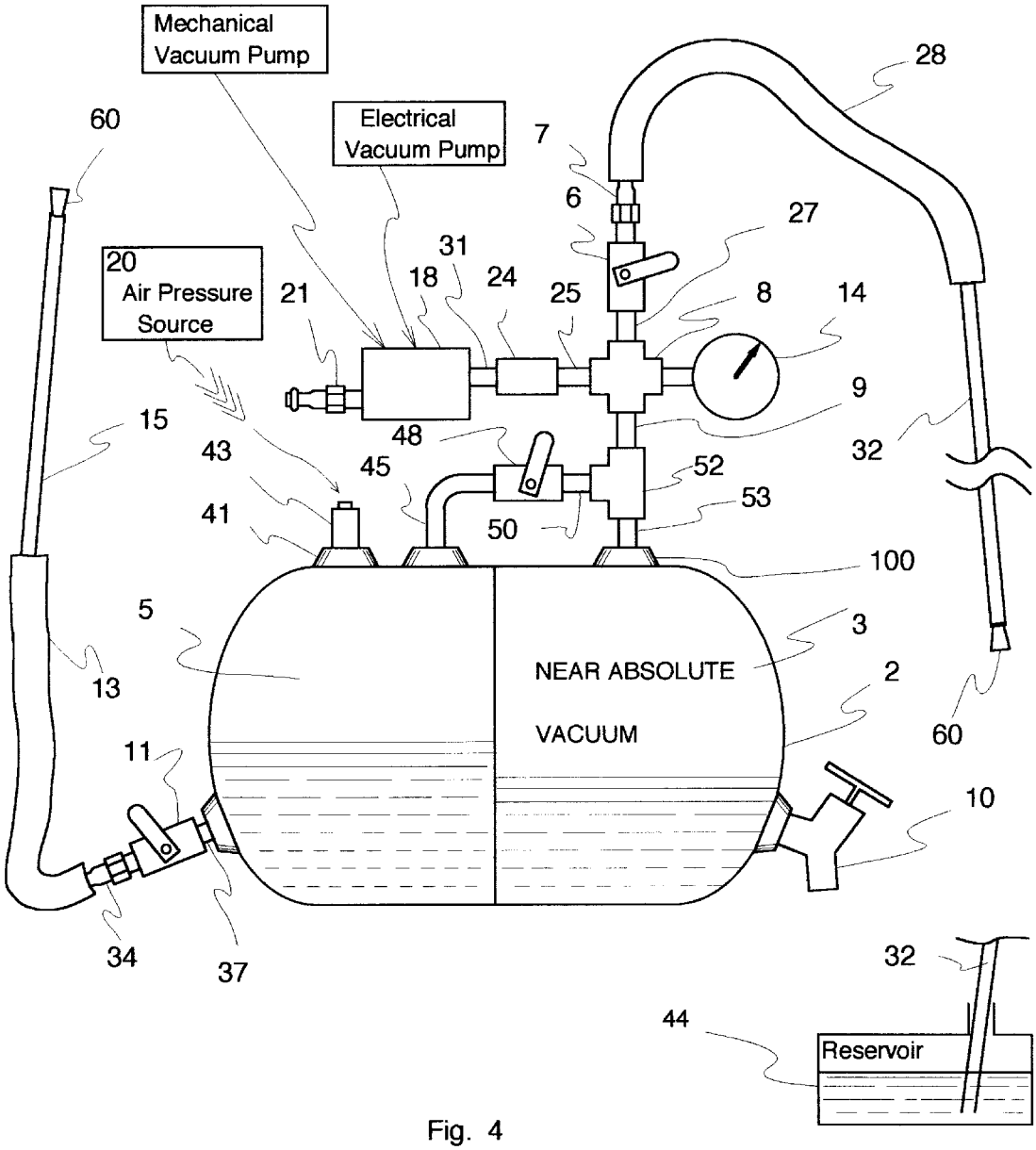
FIG. 4 illustrates an embodiment of the invention employing a vacuum charged compartment and a fluid refill compartment in a two compartment canister unit.

FIG. 4 illustrates an embodiment employing a two compartment canister and valve system which extracts and replaces fluid through two tubes. The charging and fluid extraction components of the system shown in FIG. 4 are the same as those discussed relative to FIG. 3. The versions discussed in FIGS. 1 and 2 could also be substituted for this part of the system. The extraction approach using the two compartment tank is the same as previously described for the pre-charged canister. However, the second compartment can contain bulk oil, typically slightly pressurized, which the user can use to replace the extracted fluid.

As shown in FIG. 4, tank 2 is configured to have two compartments. Compartment 3 is evacuated as described above and used to collect waste fluid, also as described above. Compartment 5 of tank 2 can be filled with fresh oil or another fluid to replenish the fluid extracted from the container from which it was drawn. Compartment 3 is connected via nipple or connecting tube 53 to one side of tee-block 52. Connector 50 connects valve 48 to the tee-block. The other side of valve 48 is connected through connector 45 to compartment 5 of tank or canister 2. The remaining side of tee-block 52 is connected to crossblock 8 through connector 27. When valve 48 is in an open position, compartments 3 and 5 are in communication through connectors 45, 50, and 53 and tee-block 52. As a result, connector 25 provides a common connection to vacuum pump 18 through check valve 24 and crossblock 8 for evacuating both compartments 3 and 5 simultaneously.

In application, tank 2 is evacuated to approximately 29" of mercury through valve 6 by way of attached, system venturi pump 18. Any available pressurized air source can be attached to the two stage venturi pump 18 by the air fitting 21. The air pressure through the venturi pump creates a vacuum in the tank, typically reaching the required levels in a few minutes. Alternatively, this embodiment can be configured with a manually or electrically powered vacuum pump. The level of vacuum is read on vacuum gage 14, which monitors the vacuum in the tank through the crossblock 8. Once 29" or other appropriate level of vacuum is reached on gage 14, the air input or other vacuum source is disconnected and the check valve 24 holds the vacuum in the tank. The second compartment 5 can be filled with the required replacement fluid by removing plug 41 and directly pouring oil or other fluid into an opening 37 in tank 2 that directs fluid into compartment 5.

Alternately, replacement fluid can be pulled into compartment 5 using the same vacuum process previously described in the other embodiments for extracting waste fluids. This is accomplished by opening valve 48 and closing valves 6 and 11. An external air pressure source is attached to air fitting 21 and vacuum pump 18, thus evacuating both compartments 3 and 5. Upon completing the evacuation, valve 48 is closed, thereby separating vacuum charged compartments 3 and 5. Oil tube 15 is then placed into a replacement fluid container (not shown) and valve 11 is turned to the "on" position, allowing the replenishment fluid to enter compartment 5. The vacuum in compartment 5 pulls the replenishment fluid through tube 15, hose 13, and valve 11 into compartment 5. Valve 11 is then turned off and a drip plug 60 is inserted into tube 15. The entire system 1 is thus pre-charged with a vacuum in compartment 3 for removing the waste liquid from its container and with replacement fluid in compartment 5.

Compartment 5 is then charged with air pressure through air valve 43 attached through plug 41, for example, to approximately 20 psi. The clean oil side of the canister, compartment 5, is pressurized, for example to 20 psi, in order to assist the replenishment fluid in traveling through valve 11 and tube 13 to the engine. Both compartments of the tank or canister 2 are now charged for operation, since compartment 3 has a vacuum for extracting waste fluid from a container and compartment 5 is charged for dispensing replenishment fluid into the container. The entire system 1 is then transported to the engine and semi-rigid tube 32 is inserted into the bottom of an engine oil container through the engine dipstick tube (not shown) in preparation of the engine oil change. The valve 6 is turned to the "vacuum on" position and the vacuum then pulls the oil out of the engine.

Warm waste engine oil is typically removed at a rate of approximately one quart per 40 seconds. When the tube is clear, the valve is shut off, the semi-rigid tube 32 is pulled from the dipstick, and the process is complete. Plug 60 is inserted into the end of semirigid tube 32 to seal off any remaining oil drips. Clean oil is assisted into the engine by opening valve 11 and allowing the air pressure to push oil from compartment 5 through the delivery tube 13 and semi-rigid tube 5 into the engine. The waste oil now in compartment 3 can be drained thru drain petcock 10 at an appropriate facility and the unit can then be readied via the same dual pre-charging process described above for the next user.

Figure 5:
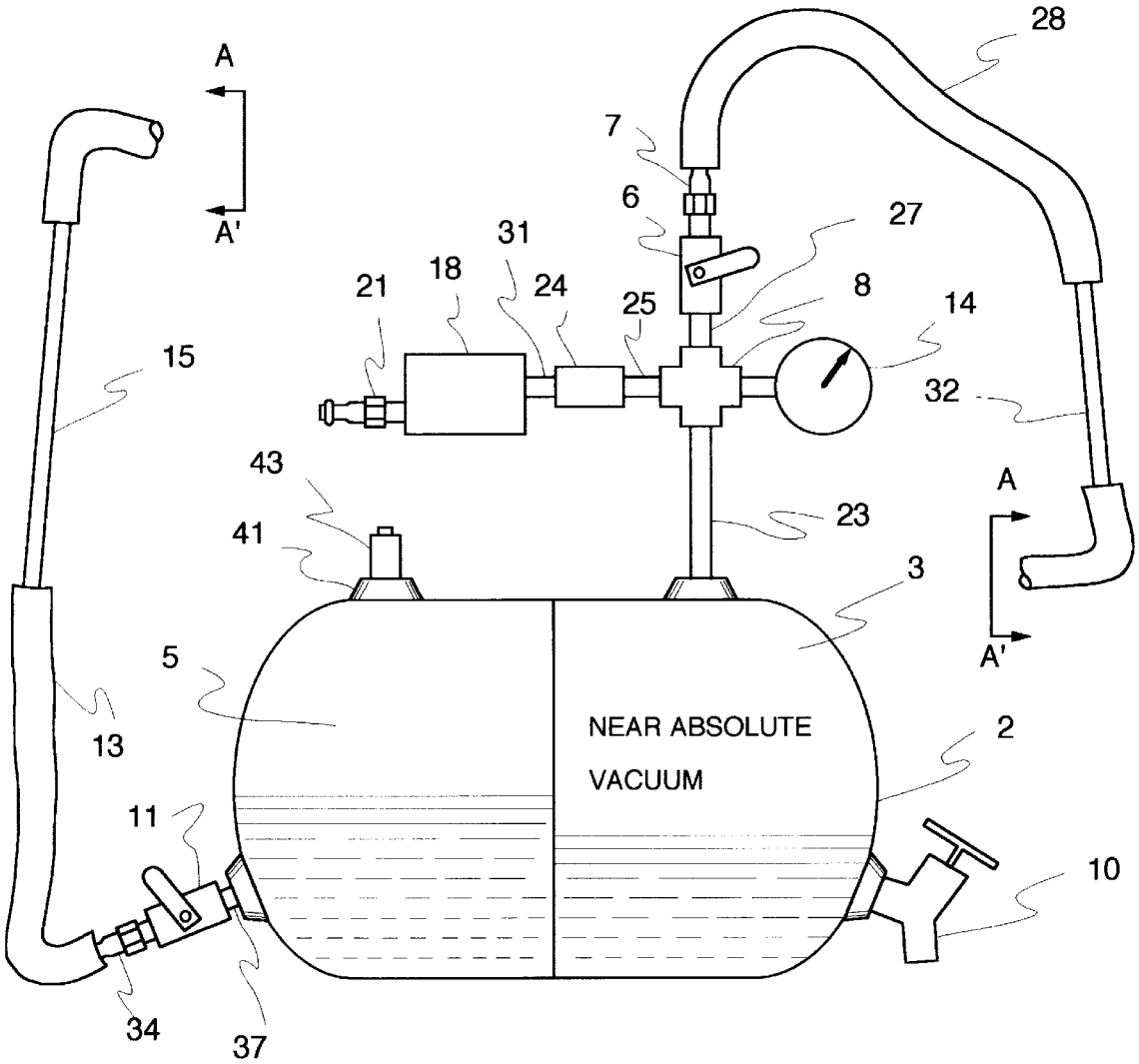
FIG. 5 illustrates another two compartment embodiment employing a valve arrangement to provide vacuum to the compartments.

FIG. 5 illustrates an embodiment employing the two compartment canister without the need for valve 48 and its connecting components. In FIG. 5, the charging and fluid extraction components are the same as those of FIG. 4. By employing the same vacuum process described above, replenishment fluid may be removed from a container (not shown) through hose 13 and valve 11 into compartment 5 of tank or canister 2 using the precharged vacuum approach discussed above.

Simultaneous evacuation of compartments 3 and 5 is accomplished by sliding an interconnecting means, such as hose 39, onto semi-rigid tubes 32 and 15. Alternately, tubes 15 and 32 can be preformed to be interconnectable. Interconnecting the tubes by either method applies the vacuum created by pump 18 to both compartments 3 and 5 simultaneously when valve 6 is opened. As previously discussed, once compartment 5 is charged with vacuum, clean oil dispursement tube 15 acts as a suction tube to take replenishment fluid into compartment 5. After replenishment fluid has been placed into compartment 5, valves 6 and 11 are closed. Next, compartment 5 is pressurized, for example to 20 psi, through air fitting 43 and plug 41. The unit is then charged and ready for use. Alternatively, a plug 41 is provided for removal, so oil may be poured into the tank directly.

At the extraction site, the extraction process is the same as the other embodiments. Valve 6 is then turned to the "vacuum on" position and the vacuum then pulls the oil out of the engine. Waste engine oil is removed by the vacuum. When the semi-rigid tube 32 is clear and the extraction process is complete, clean oil is dispensed into the engine by inserting tube 15 into the dipstick hole, turning valve 11 to the open position and allowing the pre-charged pressurized (e.g., 20 psi) compartment 5 to push oil through the delivery tube into the engine. The waste oil can be drained thru drain petcock 10 at an appropriate facility. The unit can then be readied via the same dual pre-charging process for the next use.

Figure 6:
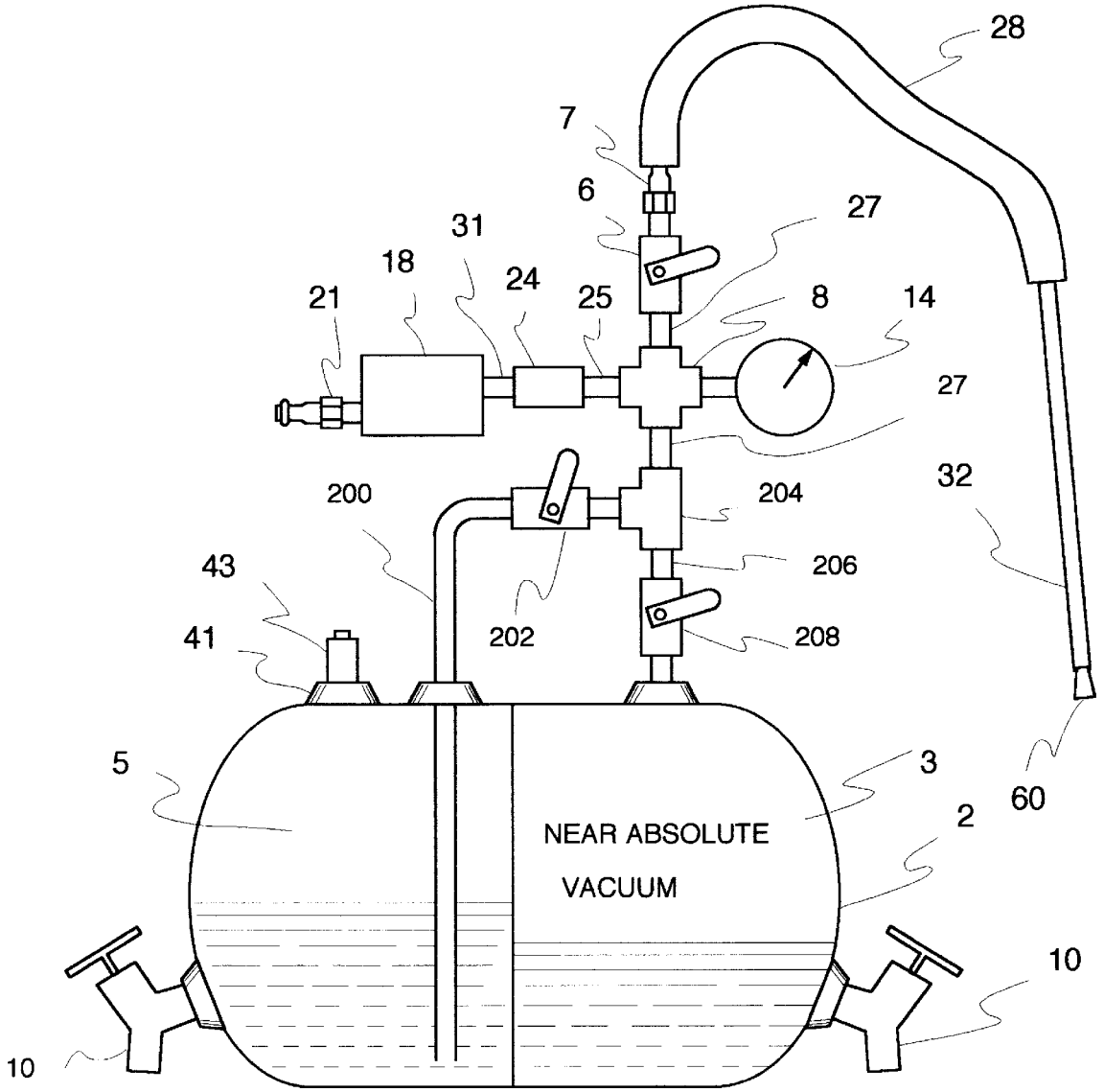
FIG. 6 illustrates a two compartment embodiment that employs a single hose for extracting and dispersing fluids.

FIG. 6 shows a configuration requiring only a single hose, which is used both for extracting waste fluid and for dispensing replenishment fluid. In this configuration, compartment 5 is connected to valve 202 through connector 200. Connector 200 is connected on one side of tee-block 204 which is connected through connected 27 to crossblock 8 and through connector 206 to valve 208. Both compartments can be precharged by opening both valves 202 and 208 while valve 6 is closed and vacuum pump 18 is activated, for example, using an external air pressure source applied at air connector 21. It should be noted that in all the embodiments discussed herein, any known vacuum pump means can be employed as pump 18, including manual and electrical pumps. Air pressure activated venturi pumps may be advantageous, since these can be powered from air pressure pumps typically available at service stations. Upon completing evacuation of compartments 3 and 5, valves 202 and 208 are closed. In order to place replenishment fluid in compartment 5, semirigid tube 32 is placed in a replenishment fluid reservoir (not shown) and valves 6 and 202 are opened while valve 208 remains closed. Replenishment fluid is drawn into compartment 5 as it replaces the vacuum in this compartment. Valve 202 is then closed and compartment 5 is then pressurized by applying air pressure through air valve 43.

A similar process as that described above is employed to extract waste oil from an engine oil container (not shown). In this case, however, valve 202 remains closed and valves 6 and 208 are opened to direct the extraction of the waste fluid through tubes 32 and 28 into compartment 3. When the extraction process is completed, valve 208 is closed and valve 202 is again opened to force replenishment fluid out of pressurized compartment 5 through tee-block 204, crossblock 8, valve 6, and tubes 28 and 32 into the engine oil container.

In the above embodiments, a near complete vacuum is generated in each canister or compartment. Thus, a substantially constant suction force is applied in each case. This results in a substantially constant rate of drawing fluid. Moreover, once the system is charged it is not necessary to apply any external power source to extract fluid, since the precharged vacuum provides all the extraction force required. The actual oil suction capacity is a function of the amount of vacuum drawn. The oil capacities shown below are calculated as tank volume times the inverse ratio to the starting vacuum pressure.

TABLE 1

| STARTING VACUUM | | CAPACITIES AT VACUUM | | | |
|---|---|---|---|---|---|
| | INCHES | | | | |
| PSI | OF | 5 GALLON TANK | | 10 GALLON TANK | |
| EQUALS | MERCURY | OIL | AIR | OIL | AIR |
| 14.70 | 29.90 | 5.00 | .00 | 10.00 | .00 |
| 14.63 | 29.75 | 4.97 | .03 | 9.95 | 0.05 |
| 14.00 | 28.48 | 4.76 | .24 | 9.52 | .48 |
| 13.50 | 27.46 | 4.59 | .41 | 9.18 | .82 |
| 13.00 | 26.44 | 4.42 | .58 | 8.84 | 1.16 |
| 12.50 | 25.43 | 4.25 | .75 | 8.50 | 1.50 |
| 12.00 | 24.41 | 4.08 | .92 | 8.16 | 1.84 |
| 11.50 | 23.39 | 3.91 | 1.09 | 7.82 | 2.18 |
| 11.0 | 22.37 | 3.74 | 1.26 | 7.48 | 2.52 |
| 10.50 | 21.36 | 3.57 | 1.43 | 7.14 | 2.86 |
| 10.00 | 20.34 | 3.40 | 1.60 | 6.80 | 3.20 |
| 9.50 | 19.32 | 3.23 | 1.77 | 6.46 | 3.54 |
| 9.00 | 18.31 | 3.06 | 1.94 | 6.12 | 3.88 |
| 8.50 | 17.29 | 2.89 | 2.11 | 5.78 | 4.22 |
| 8.00 | 16.27 | 2.72 | 2.28 | 5.44 | 4.56 |

TABLE 1-continued

| STARTING VACUUM | | CAPACITIES AT VACUUM | | | |
|---|---|---|---|---|---|
| | INCHES | | | | |
| PSI | OF | 5 GALLON TANK | | 10 GALLON TANK | |
| EQUALS | MERCURY | OIL | AIR | OIL | AIR |
| 7.50 | 15.26 | 2.55 | 2.45 | 5.10 | 4.90 |
| 7.00 | 14.24 | 2.38 | 2.62 | 4.76 | 5.24 |
| 6.50 | 13.22 | 2.21 | 2.79 | 4.42 | 5.58 |
| 6.00 | 12.20 | 2.04 | 2.96 | 4.08 | 5.92 |
| 5.50 | 11.19 | 1.87 | 3.13 | 3.74 | 6.26 |
| 5.00 | 10.17 | 1.70 | 3.30 | 3.40 | 6.60 |
| 4.50 | 9.15 | 1.53 | 3.47 | 3.06 | 6.94 |
| 4.00 | 8.14 | 1.36 | 3.64 | 2.72 | 7.28 |
| 3.50 | 7.12 | 1.19 | 3.81 | 2.38 | 7.62 |
| 3.00 | 6.10 | 1.02 | 3.98 | 2.04 | 7.96 |
| 2.50 | 5.09 | .85 | 4.15 | 1.70 | 8.30 |
| 2.00 | 4.07 | .68 | 4.32 | 1.36 | 8.64 |
| 1.50 | 3.05 | .51 | 4.49 | 1.02 | 8.98 |
| 1.00 | 2.03 | .34 | 4.66 | .68 | 9.32 |
| .50 | 1.02 | .17 | 4.83 | .34 | 9.66 |
| .00 | .00 | .00 | 5.00 | .00 | 10.00 |

While the invention has been particularly shown and described with reference to several preferred embodiments, it will be understood by those skilled in the art that various changes in form and detail may be made without departing from the scope and spirit of the invention recited in the appended claims.

What is claimed is:

1. A method of drawing fluid from, and/or supplying fluid to a reservoir, the method comprising the steps of:

precharging a first compartment of a multi-compartment canister by evacuating a first compartment to form a near absolute vacuum in the first compartment;

sealing the first compartment with a closing means;

drawing in fluid to be supplied to a reservoir into a second compartment of the canister;

pressurizing the fluid containing second compartment with air to form a pressurized, pre-charged second compartment;

connecting a first hose between the sealed first compartment and the reservoir;

releasing the closing means, thereby suctioning fluid from the reservoir through the first hose and into the first compartment without external power, the suctioned fluid thereby at least partially replacing the vacuum in the canister; and delivering fluid from the pre-charged, pressurized second compartment to the reservoir through a second hose connected between the second compartment and the reservoir.

2. The method recited in claim 1 wherein the step of drawing replacement fluid into the second compartment further comprises:

precharging the second compartment by evacuating the second compartment to form a near absolute vacuum in the second compartment and sealing the second compartment;

inserting said second hose into a replenishing fluid; and releasing the vacuum in the second compartment thereby drawing replenishment fluid through the second hose in order, at least partially, to replace the vacuum in the second compartment.

3. The method recited in claim 2 and further comprising the step of:

simultaneously evacuating said first and second compartments.

4. The method recited in claim 3 wherein the first and second compartments are simultaneously evacuated through a high vacuum check valve and comprising the further steps of:

valving off the first hose to the reservoir; and applying a vacuum source to a check valve in communication between the vacuum source and said canister in order to maintain the evacuated vacuum in the first and second compartments of the canister.

5. The method recited in claim 2 wherein the first and second compartments are simultaneously evacuated by the steps of:

applying a vacuum source to a check valve having a first end connected to the vacuum source and a second end connected to the canister in order to establish and maintain the vacuum in both of said compartments of the canister.

6. An apparatus for drawing waste fluid from a reservoir and refilling the reservoir with fresh replacement fluid, the apparatus comprising:

a canister having first and second compartments, the first compartment being precharged by evacuating the first compartment to form a near absolute vacuum in the first compartment;

means for drawing in the fresh replacement fluid into a second compartment of the canister;

an air pressure inlet valve for charging the second compartment with air pressure to form a pressurized second compartment;

a first hose connected between the first compartment and the reservoir;

means for holding and releasing said near absolute vacuum from said first compartment in order to suction fluid from the reservoir through the first hose and into the first compartment without external power, the fluid thereby partially replacing the vacuum in the first compartment; and a second hose connected to the second compartment for delivering the fresh replacement fluid from the pressurized second compartment to the reservoir.

7. The apparatus recited in claim 6 and further comprising:

a valve located between the first and second compartments, the valve having a first position interconnecting the first and second compartments for simultaneous evacuation of the first and second compartments, and said valve further having a second position for isolating the first and second compartments from each other.

8. The apparatus recited in claim 7 and further comprising:

means for capturing and then releasing a vacuum in the second compartment, the released vacuum in the second compartment providing suction for the fresh replenishment fluid to be drawn into the second compartment.

9. The apparatus recited in claim 6 wherein the first and second hoses have outward ends which may be sealably connectable, and said apparatus further comprising:

a first open/close valve connected to an inward end of the first hose, the open/close valve having open and closed positions, said open/close valve being further characterized in that, in the open position, said valve provides communication between the canister and the inward end of the first hose; and a second open/close valve between the second compartment and the inward end of the second hose, the second open/close valve also having an open and closed position such that when both first and second open/close valves are in an open condition the first and second canister compartments may be simultaneously evacuated.

10. An apparatus for transferring fluid from an external reservoir and back to the same or another reservoir, said apparatus comprising: a prechargeable, sealable canister which may be evacuated to form a vacuum to be captured in the canister when the canister is disconnected from a vacuum source and which may also be pressurized to capture and hold a positive pressure in said canister when the canister is disconnected from a pressure source; one or more fluid conducting means in valved fluid conducting relationship with said canister and further in communication externally with an external reservoir; valve means for capturing said vacuum in said canister when the canister is disconnected from the vacuum source such that the vacuum may be controllably exposed to a fluid in another location;

means for controllably releasing the captured vacuum in the canister so that the released vacuum suctions fluid from a reservoir through the fluid conducting means into the canister with the fluid thereby partially replacing the vacuum in the canister; pressurized fluid capturing means for capturing and holding fluid in said canister under pressure when the canister is disconnected from a pressure source, which pressurized fluid can be controllably transferred from the canister to an external reservoir; and means controllably releasing the pressurized fluid from within the canister for transferring fluid under positive pressure from said canister to a reservoir.

11. The apparatus recited in claim 10 wherein the pressurized fluid capturing means is further characterized by comprising:

means for placing replacement fluid in a pressurizeable side of the canister in order to transfer said replacement fluid from said canister into said reservoir.

12. The apparatus recited in claim 10 wherein the canister is portable and is further characterized by comprising:

means for transferring the withdrawn fluid that has been suctioned into the canister outward to an external waste-receiving reservoir.

13. The apparatus recited in claim 10 wherein the fluid conducting means is further characterized by comprising:

a hose connected to said canister at one end and having a reducer tip at the other end, with said reducer tip being adapted to fit within a limited access reservoir for fluid transfer.

14. The apparatus recited in claim 10 and further characterized as comprising:

a vacuum pump connected to said canister for evacuating said canister to a near absolute vacuum.

15. The apparatus recited in claim 14 wherein said vacuum pump is further characterized as comprising:

an air pressure-driven, two-stage venturi vacuum pump such as those capable of being driven by a shop or service station air compressor.

16. The apparatus recited in claim 14 wherein said vacuum pump is further characterized as comprising:

an electrically driven vacuum pump capable of drawing said canister down to a near absolute vacuum.

17. The apparatus recited in claim 10 wherein said apparatus is further characterized as comprising:

means for moving the suctioned waste fluid from the canister into another external waste disposal reservoir.

18. The apparatus recited in claim 17 wherein said waste fluid moving means is further characterized as comprising:

a manually operable drain valve located in the lower part of the canister and suitable for cavity draining.

19. The apparatus recited in claim 17 wherein said waste fluid moving means is further characterized as contained pressurized fluid, and said apparatus further comprises:

a manually operable flushing valve for controllably expelling waste fluid under pressure from said canister.

20. The apparatus recited in claim 17 wherein said apparatus includes a valved opening to said vacuum in said canister and said fluid conducting means of the apparatus is further characterized by comprising:

a first hose connected to said valved vacuum opening in said canister; and said fluid moving means includes a second hose connected between said canister and any external reservoir for transferring fluid from said canister to the reservoir.

21. The apparatus recited in claim 17 wherein said canister is both portable and spill-proof by sealed valving means and said means for flushing the suctioned waste fluid from the canister into another external waste disposal is further characterized as comprising:

a means for disposing of said waste fluid that is hands-off, said hands-off means comprising valving or fluid hose conducting means which are sealed from the atmosphere and environment.

22. The apparatus recited in claim 17 wherein said canister is further characterized as comprising:

a canister that is either first precharged with a vacuum such that fluid removal at a remote site is free of external power other than that represented by the precharged vacuum and/or is pressurized so that said waste fluid withdrawal and said waste fluid disposal is done at a remote site free of external power other than that represented by the precharged and pressurized states of the canister itself.

23. The apparatus recited in claim 10 wherein the canister has at least two individual interior compartments, and said apparatus is further characterized by comprising:

one compartment is a compartment for capturing and holding said vacuum; and another of said compartments may capture and hold vacuum or pressurized fluid.

24. The apparatus recited in claim 23 wherein said apparatus is further characterized by comprising:

said vacuum compartment further comprises valving means for connecting and controlling fluid transfer from said vacuum compartment and to the reservoir.

25. The apparatus recited in claim 24 wherein said apparatus is further characterized by comprising:

one individual compartment that is isolated from the other compartment and is designated as a compartment for capturing and holding pressurized fluid; and said pressurized compartment further comprises means connecting said fluid transfer means between said pressurized compartment and the external reservoir for controllably supplying fluid from within the pressurized compartment to an external reservoir.

26. The apparatus recited in claim 24 wherein said fluid conducting means is further characterized by comprising:

a vacuum hose connected to said canister at one end and having a reducer tip at the other end, with said reducer tip being adapted for a limited access reservoir from which fluid is to be transferred.

27. The apparatus recited in claim 10 wherein the canister has individual compartments, and said apparatus is further characterized by comprising:

means for evacuating one or more of said compartments to said near absolute vacuum; and means for pressurizing at least one of said compartments.

28. The apparatus recited in claim 10 wherein the apparatus is further characterized by comprising:

valving means for switching between a vacuum mode and a pressure mode for said canister.

29. The apparatus recited in claim 28 wherein the apparatus is further characterized by comprising:

gauge means for indicating the extent of vacuum/pressure in said canister.

30. The apparatus recited in claim 10 wherein the canister is portable and said apparatus is for exchanging fluids within a same reservoir or transferring a same fluid from one reservoir to another reservoir, said apparatus is further characterized by comprising:

said vacuum capturing means is a vacuum check valve for automatically capturing said vacuum in said canister when said canister is disconnected from an external source of vacuum.

31. The apparatus recited in claim 30 wherein the canister includes a void space, and said pressurized fluid capturing means is further characterized by comprising:

means isolating the void space in said canister from said vacuum check valve in order to place pressurized fluid in said portable canister such that the portable canister can transfer the pressurized fluid to an external reservoir.

32. The apparatus recited in claim 31 wherein the canister includes a near absolute vacuum, and said pressurized fluid capturing means is further characterized by comprising:

an air pressure valve that holds against an absolute vacuum and further captures and holds air pressure within the canister when said canister is disconnected from an external pressure source.

* * * * *